US005430955A

United States Patent [19]

Pietro

[11] Patent Number: 5,430,955

[45] Date of Patent: Jul. 11, 1995

[54] SEALING DEVICE FOR FEEDING FABRICS INTO A CONTINUOUSLY DECATIZING AUTOCLAVE

[76] Inventor: Alberto Pietro, Strada Masserano Calaria, 70 - Biella, Italy

[21] Appl. No.: 137,080

[22] PCT Filed: Apr. 23, 1992

[86] PCT No.: PCT/IT92/00047

§ 371 Date: Oct. 18, 1993

§ 102(e) Date: Oct. 18, 1993

[87] PCT Pub. No.: WO92/18679

PCT Pub. Date: Oct. 29, 1992

[30] Foreign Application Priority Data

Apr. 23, 1991 [IT] Italy ..... MI91A1119

[51] Int. Cl.[6] ..... F26B 25/00

[52] U.S. Cl. ..... 34/242; 68/5 E

[58] Field of Search ..... 34/242, 123, 116; 68/5 E

[56] References Cited

U.S. PATENT DOCUMENTS

| | | | |
|---|---|---|---|
| 1,698,818 | 1/1929 | Lorenz | 34/123 |
| 2,834,193 | 5/1958 | Fahringer | 34/242 |
| 3,158,507 | 11/1964 | Alexander | 34/242 |
| 3,645,116 | 2/1972 | Peter | 34/242 |
| 3,854,222 | 12/1974 | Lesh et al. | 34/15 |
| 4,124,942 | 11/1978 | Ohls | 34/242 |
| 4,301,665 | 11/1981 | Lopata | 34/242 |
| 4,622,758 | 11/1986 | Lehtinen et al. | 34/116 |
| 5,301,521 | 4/1994 | Bertoldo | 34/123 |

FOREIGN PATENT DOCUMENTS

| | | |
|---|---|---|
| 1395790 | 6/1967 | France . |
| 2234404 | 1/1975 | France . |
| 2277175 | 1/1976 | France . |
| 2546259 | 11/1984 | France . |
| 1206866 | 12/1965 | Germany . |
| 2810660 | 9/1979 | Germany . |

*Primary Examiner*—Denise L. Gromada

*Attorney, Agent, or Firm*—Panitch Schwarze Jacobs & Nadel

[57] ABSTRACT

A device for feeding a fabric in a continuously decatizing autoclave, provides improved steam tightness characteristics. A rotating cylinder suitable to close the slot through which the fabric and associate back cloth are passing is provided at the inlet and at the outlet of autoclave, the feed and respective withdrawal of the fabric is at the same speed as a consequence of the friction between the cylinder and two opposite resilient elements, preferably inflatable tubes acting as a gasket. An anti-friction material is interposed to reduce wear. Preferably the cylinder is formed in two parts, with two end resilient rings and two disks of anti-friction material at the ends for a seal against fixed side walls or a portion thereof resiliently biased against the rotating cylinder.

6 Claims, 2 Drawing Sheets

SEALING DEVICE FOR FEEDING FABRICS INTO A CONTINUOUSLY DECATIZING AUTOCLAVE

FIELD OF THE INVENTION

The present invention relates to an improved sealing device for feeding fabrics into a continuously decatizing autoclave.

BACKGROUND OF THE INVENTION

It is known to submit fabrics, for a better finish thereof, to a so-called decatizing operation wherein the fabric, coupled with a support element, called "back cloth", is subjected to steam action in association with a determined mechanical behaviour. There are various types of decatizing, above all according to the mechanical action exerted, e.g. of either compression or drawing, or depending on the fact that decatizing is made freely or in autoclave.

It is also known that the best results of decatizing are obtained in an autoclave at the inside of which the fabric piece is fed in subsequent batches, being wound on a perforated cylinder. The decatizing operation in the autoclave has been tentatively made continuous, and affords remarkable advatanges by eliminating the need of opening the autoclave, taking off the treated fabric roll therefrom and introducing the subsequent roll with consequent dead times and reduction of productivity, as well as the generation of transient periods at each cycle before reaching the value of normal working pressure within the autoclave.

With the Italian Patent No. 1.202.577 in the name of the same applicant has been proposed an autoclave continuously decatizing apparatus which solved most of the difficulties that in the past had prevented adequate development of this technology. However there still remained certain unsolved problems relating mainly to the steam tightness in the zone where the fabric with the back cloth is fed and the so-called "sandwich" gets off from the autoclave. As a matter of fact in the continuos autoclave decatizing a zone of communication with the outside cannot be avoided which, even if reduced to a slot only, provides for leakage of the pressurized steam.

Therefore it is an object of the present invention to provide a device for feeding a fabric into an autoclave and for the withdrawal therefrom such as to show an efficient seal action against steam under pressure in spite of having a particularly simple structure.

SUMMARY OF THE INVENTION

The device according to the invention comprises a cylinder which substantially occupies the whole space of the autoclave inlet and outlet slot, as it is rotatably mounted about its longitudinal axis positioned at a transverse direction to the fabric forward movement. A first resilient sealing means is provided at two opposite generatrices of the cylinder, suitable to improve adherence between feeding cylinder and fabric, as well as to avoid steam leakages. A second lateral sealing means is also provided, of resilient character, at both ends of the cylinder with respect to the side walls of said slot.

According to a preferred embodiment said first sealing means comprises inflatable tubes under pressure and in an even more preferred way between said sealing means and the fabric there is placed an anti-friction material sheet to reduce wear.

According to another preferred embodiment said second lateral sealing means comprises resilient disk components of the cylinder being suitable to press the end elements of the cylinder, formed of anti-friction disks, towards the side walls of the slot, these latter being possibly movable and in this case there being provided means for elastically biasing in turn said movable walls from opposite sides against the ends of said cylinder.

BRIEF DESCRIPTION OF THE DRAWINGS

These and additional objects, advantages and characteristics of the device according to the present invention will become clearer from the following description given by way of example with reference to the drawings in which.

DETAILED DESCRIPTION OF THE PREFERRED EMBODIMENTS

Figure 1:
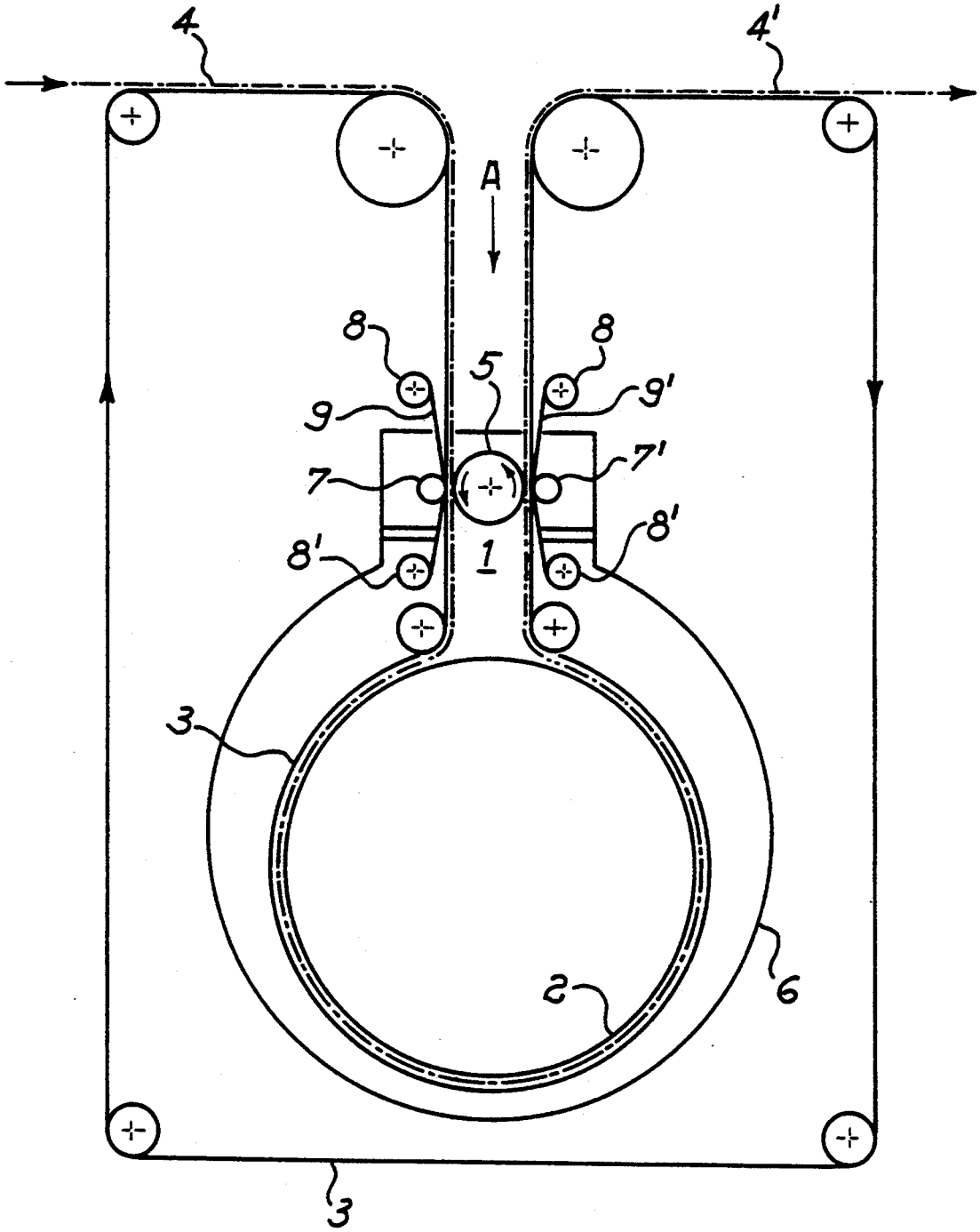
FIG. 1 shows a cross-section view of a continuous decatizing autoclave provided with the improved seal feeding device according to the invention.

With reference to FIG. 1 there is shown an autoclave 6 for continuous decatizing, provided with a device according to the invention in the area of slot 1 of inlet and outlet of fabric 4 (designated 4' when discharged) being coupled to an endless web of back cloth 3 winding for the most part of its 360° around a perforated cylinder 2 within the autoclave. As is known, the pressurized steam passes throughout the holes of the perforated cylinder 2 and impinges the assembly formed of the supporting back cloth 3 and fabric 4 while an almost complete turn is made about the lateral surface of cylinder 2. Therefore the fabric undergoes a mechanical-thermal action of the steam, as is peculiar to a decatizing operation.

According to the present invention, the slot 1 putting into communication autoclave 6 to the outside is sealed off by a device 5 formed of a rotatable cylinder having also the very important purpose of feeding into the autoclave and at the same time withdrawing therefrom the back cloth 3 and fabric 4 by rotating in the direction of arrows shown in the drawing toward the length of already treated fabric 4'. Motor means are provided to rotate cylinder 5 at the desired speed or as an alternative the latter, having its axis cross-wise to the forward direction of the fabric, can be driven by the assembly of materials 3 and 4.

The friction generated, at two diametrally opposite generatrices by cylinder 5 against the fabric 4 at the inlet and treated fabric 4' at the outlet from autoclave 6 causes the fabric to be continuously fed and withdrawn from the autoclave exactly at the same speed. In order to avoid slipping and at the same time to improve sealing, on opposite sides of cylinder 5 at the generatrices of contact with the fabric there are provided two gaskets 7, 7', preferably of resilient material such as rubber, which when inflated by compressed air like tire inner tubes, rest on the cylinder 5 from opposite sides while exerting thereon a stong pressure. It will be appreciated that, instead of this solution the gasket 7, 7' whenever of resilient character could be provided otherwise, differently shaped and the thrust against the cylinder could be obtained with different means such as springs, resilient elements, rotations of an elliptical gasket etc. without anyhow modifying the inventive concept.

In any case it will be necessary that the bias exerted onto gaskets 7, 7' is greater than the thrust due to the steam leakage, in particular the pressure of compressed air in both inflatable tubes, when this solution is adopted, will be higher than the vapor pressure within autoclave.

This strong pressure has the tendency to squeeze the fabric against the feeding cylinder 5 to prevent leakage, thus involving a remarkable friction which on one hand is useful to avoid slipping between cylinder 2 and fabric 4, whereby the correct feeding and withdrawal speed from the autoclave 6 is ensured, but on the other side gives rise to some wear of the gasket, if made stationary, owing to the rubbing with the back cloth 3.

To avoid the wear on the gasket 7, there may be placed, as shown in FIG. 1, an intermediate web or film of anti-friction material 9, being very smooth-running and heat resistant, such as teflon, preventing the inflatable tube gasket 7 from contact with the endless web 3. At the other side there is similarly arranged an anti-friction material 9' to prevent the gasket 7' from wearing. At each side said anti-friction sheets 9, 9' may be wound about rolls 8, 8' whereby they have a slight feed (e.g. 1–2 cm/day) in a continuous or periodic way (such as sometimes a week) according to the requirements, thus varying the point of contact and friction with the consequence of having a reduced wear of the gasket. An operator or an automatic means of known type will cause a slight rotation of rolls 8, 8' on which the sheets of material 9, 9' are wound, once or more times every day, or sometimes a week, so that said sheets have a slight movement thus showing each time a new zone of contact.

It will be appreciated that all the above assumes that an autoclave is used being fed from the outside with steam, such as through a conduit coaxial with cylinder 2. However it is clear that the same invention can be validly adopted also with an autoclave filled with boiling water at a temperature higher than or lower than 100° C. for a wet-decatizing of fabrics. This type of decatizing, usually called "Potting" is carried out as a rule on fabrics immediately before or after a washing step. It will be also noted that boiling water could be kept at a low level whereby in the autoclave there could be at the same time hot water and steam.

In any case it is clear that the sealing system as described so far would not be sufficient to prevent steam from escaping the autoclave, unless in the longitudinal direction only, i.e. parallel to the direction of fabric feed and withdrawal. However also the side leakages should not be neglected, in other words those which unavoidably would occur between the rotating cylinder 5 and side walls of slot 1.

Figure 2:
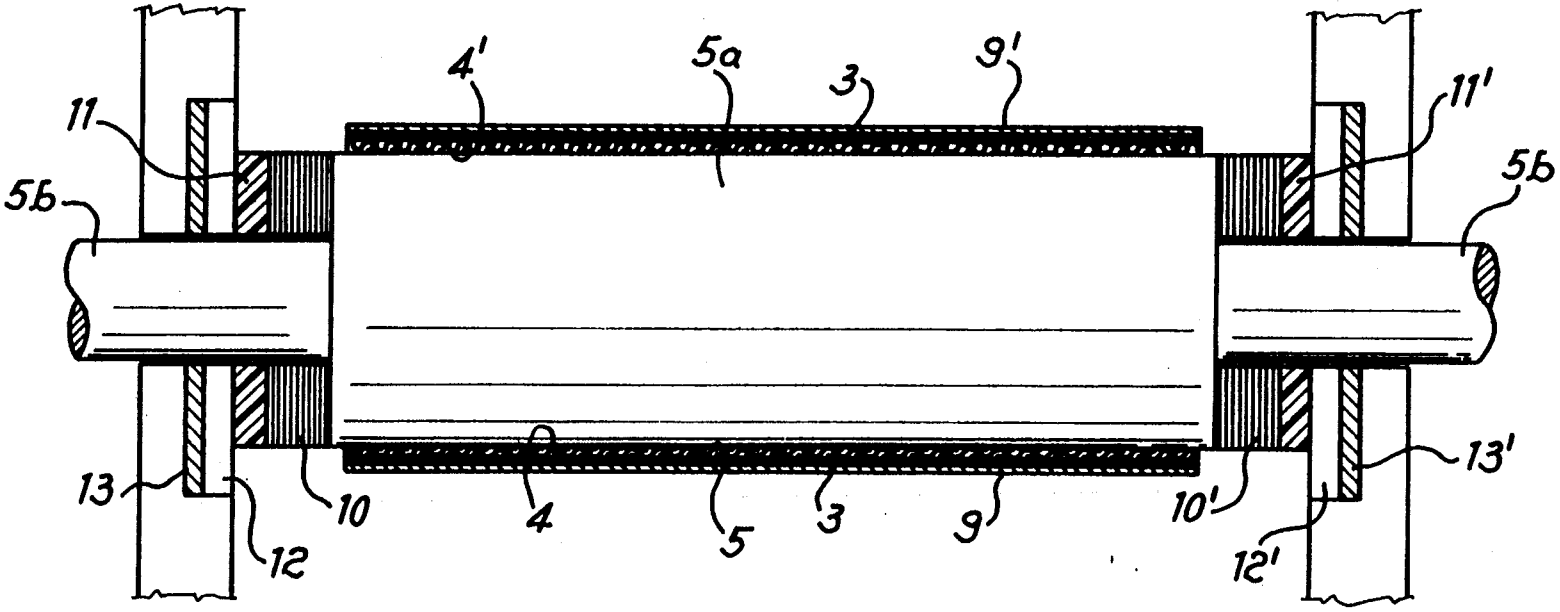
FIG. 2 shows a view, in an enlarged scale, of only the detail relating to the feeding device as viewed in the direction of arrow A in FIG. 1.

With reference to FIG. 2, showing an enlarged view of cylinder 5, with respect to FIG. 1, taken in the direction of arrow A and with the plane of FIG. 2 being perpendicular to the fabric feed forward direction, the feeding cylinder 5 is preferably formed, according to the invention, in a number of parts. In particular, as shown in FIG. 2, at the outer sides of a central body **5*a* mounted on a support shaft 5*b*, two resilient rings 10, 10' are symmetrically provided and, at an outer position, two disks of anti-friction material 11, 11', such as teflon. The side walls of slot 1 are schematically represented in the drawing by elements 12, 12'. Therefore, of the portions forming cylinder 5, at least one ring 10, 10' on each side is of elastic material which, previously compressed during assembly, biases against the walls 12 and 12' the two anti-friction disks 11, 11'**.

Accordingly, the steam can no longer escape along the lateral surface, or from the heads of cylinder 5.

With side walls 12, 12' made stationary, the tightness will depend only on the elasticity of material 10, 10'. However the walls 12, 12' may be also movable and urged to the inside of cylinder 5 by a resilient means, respectively 13, 13' provided for example by compressed air, oil in pressure, springs, self-controllable outer motor, etc. In this case the lateral tightness will be due partially to the resilient means 12, 12' forming the side walls of slot 1. Practical tests have shown that a sealing of this type is preferable.

I claim:

1. An improved sealing device for a continuously decatizing autoclave having a perforated cylinder mounted therein and a slot, the slot being defined by two side walls, comprising:

a cylinder rotatably mounted within the slot about a longitudinal axis and positioned transversely with respect to a fabric cloth forward feeding direction whereby rotation of the cylinder in a prefixed direction causes a fabric cloth and an associated fabric back cloth to be fed into the autoclave at a predetermined speed and contemporaneously withdrawn therefrom on an opposite side of the cylinder at generally the same speed; and first sealing means comprised of resilient inflatable elastic elements disposed at opposite generatrices of the cylinder for sealing and adding adherence between the cylinder and the cloth and back cloth for preventing steam leakage therefrom.

2. The sealing device according to claim 1, further comprising anti-friction sheets located between the sealing means and the back cloth.

3. A device according to claim 2, further comprising pairs of rollers about which the anti-friction sheets are wound for periodic forward movement of the anti-friction sheets for varying a zone of contact with the first sealing means.

4. A device according to claim 1, wherein the first sealing means is formed as gaskets elastically biased against the cylinder.

5. A device according to claim 1, further comprising:

second sealing means for lateral sealing comprising at least one resilient disk proximate a side of a central body of the cylinder; and end disks comprised of an anti-friction material proximate the side walls of said slot, wherein the at least one resilient disk urges the end disks against the side walls of said slot.

6. A device according to claim 5, wherein the side walls are movable, and further comprising biasing elastic means for urging the side walls toward the inside of the cylinder.

* * * * *